US009634431B1

(12) United States Patent
Onlao et al.

(10) Patent No.: US 9,634,431 B1
(45) Date of Patent: Apr. 25, 2017

(54) CLAMP CUP TO SECURE ELECTRICAL CONNECTORS HAVING FIRST AND SECOND MATING STRUCTURES

(71) Applicant: Western Digital Technologies, Inc., Irvine, CA (US)

(72) Inventors: Sornpet Onlao, Thanyaburi (TH); Akaney Rien-Ngoen, Klongluang (TH)

(73) Assignee: Western Digital Technologies, Inc., Irvine, CA (US)

( * ) Notice: Subject to any disclaimer, the term of this patent is extended or adjusted under 35 U.S.C. 154(b) by 0 days.

(21) Appl. No.: 15/052,771

(22) Filed: Feb. 24, 2016

(51) Int. Cl.
*H01R 13/44* (2006.01)
*H01R 13/639* (2006.01)

(52) U.S. Cl.
CPC ..... *H01R 13/6395* (2013.01)

(58) Field of Classification Search
CPC ..... H01R 13/6395
USPC ..... 439/149, 320, 373, 544, 551
See application file for complete search history.

(56) References Cited

U.S. PATENT DOCUMENTS 2,722,665 A * 11/1955 Sauder ..... H01R 13/447 174/67
3,723,944 A 3/1973 Gauchat et al.
4,531,800 A * 7/1985 Avener ..... H01R 13/625 439/147
4,653,835 A * 3/1987 Schulte ..... H01R 13/743 439/277
5,505,634 A 4/1996 Osten
5,589,665 A * 12/1996 Scamacca ..... H02G 3/14 174/56
5,989,052 A * 11/1999 Fields ..... H01R 13/447 439/144
6,939,161 B1 * 9/2005 Yi ..... H01R 13/6395 439/373
7,080,889 B2 7/2006 Ling et al.
7,749,015 B2 * 7/2010 Uchikawa ..... H01R 13/6395 439/362
8,087,322 B1 * 1/2012 Morris ..... E05B 15/0013 49/246
8,152,554 B2 4/2012 Chapel et al.
9,065,207 B2 6/2015 Chapel et al.
2005/0042917 A1 * 2/2005 Wu ..... F21S 8/065 439/551
2010/0120276 A1 * 5/2010 White ..... H01R 13/447 439/148
2015/0064960 A1 3/2015 Chapel et al.

* cited by examiner

*Primary Examiner* — Tho D Ta

(57) ABSTRACT

A device comprises a connector support configured to receive and support a first electrical connector and comprising a first surface configured to face and attach to a housing wall and a second surface comprising first mating structure extending away from the housing wall; and a clamp cup configured to receive and at least partially surround a cable and a second electrical connector attached to the cable, the second electrical connector being configured to mate with the first electrical connector, the clamp cup comprising an outer surface and a second mating structure, the clamp cup being configured to removably fit over and attach to the connector support by mutual engagement of the first and second mating structures to mate the first and second electrical connectors and hold the mated first and second electrical connectors against the housing wall.

18 Claims, 6 Drawing Sheets

CLAMP CUP TO SECURE ELECTRICAL CONNECTORS HAVING FIRST AND SECOND MATING STRUCTURES

BACKGROUND

Many manufacturing machines and other electrical devices use electrical power cords and connectors, such as shown in FIG. 1. FIG. 1 shows a cable 103 connected to a C13 connector 102 and a mating C14 connector. The C13 connector 102 extends from the cable 103 and plugs into the C14 connector 104. The C14 connector 104 may be mounted on a panel of the manufacturing machine or electrical device. However, the manufacturing machine or electrical device may be moved or jostled during normal use, maintenance or repair. Moreover, the power cord 103 may be accidently pulled due to operator traffic, thereby causing the mated C13 connector and mated C14 connector to accidently separate from one another, which results in machine downtime, lower productivity and possible loss of data. In some operations, down time due to accidental power cord disconnection can add up to several hours a month.

Conventionally, C13 and C14 connectors may be locked to one another, to prevent just such accidental disconnections. Existing connector locks include the International Electrotechnical Commission (IEC) lock, the MEC clip lock and the National Electrical Manufacturers Association (NEMA) 520 lock. The IEC lock, however, requires C13 and C14 connectors that have been modified with push buttons. The MEC clip lock features large metal clips that contact and span the connectors. However, the large metal clip has a tendency to bend and is not robust. Lastly, the NEMA 520 lock includes an outlet module and a spur locking pin. However, installation of this locking mechanism requires one or two days and the lock itself is costly.

DETAILED DESCRIPTION

One embodiment is configured to securely attach a first electrical connector to a second, mating, electrical connector. Although the illustrated embodiments show an electrical power connector and C13 and C14 connectors in particular, the electrical connectors need not be so limited. Indeed, the electrical connectors may be data connectors or may be data and power connectors and the structure of the devices and assemblies disclosed herein may be readily adapted to such data and/or data and power connectors.

Figure 1:
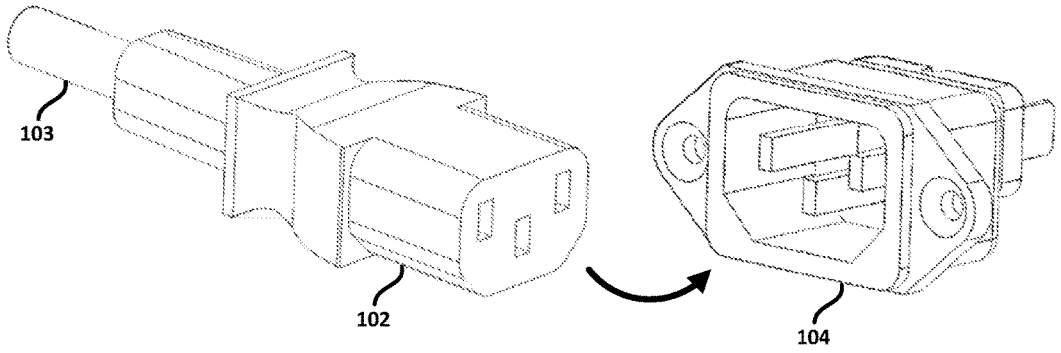
FIG. 1 (Prior Art)
FIG. 1 shows a conventional cable and C13 connector and a mating C14 connector.
Figure 2:
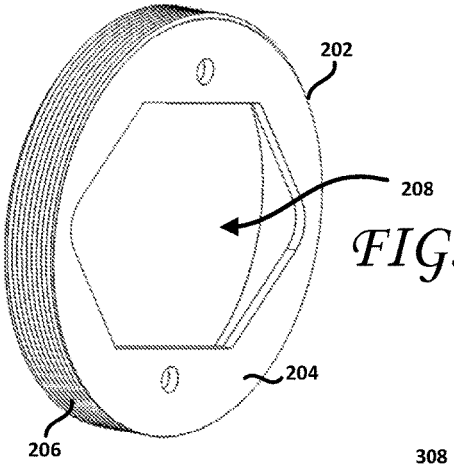
FIG. 2 is a view of a connector support, according to one embodiment.
Figure 3:
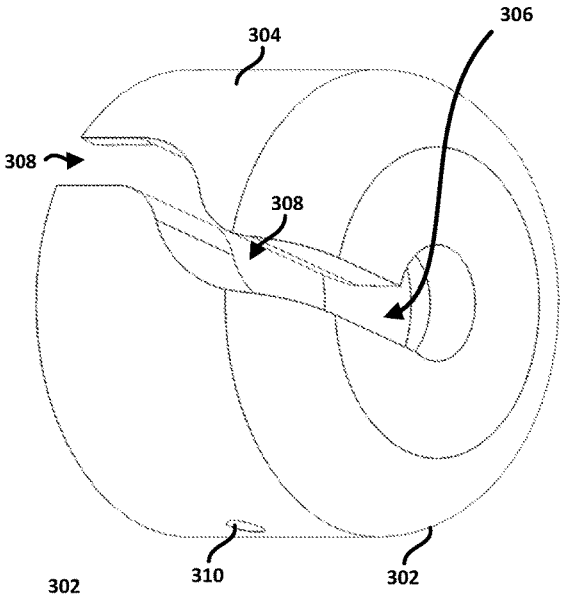
FIG. 3 is a perspective representation of a clamp cup, according to one embodiment.
Figure 4:
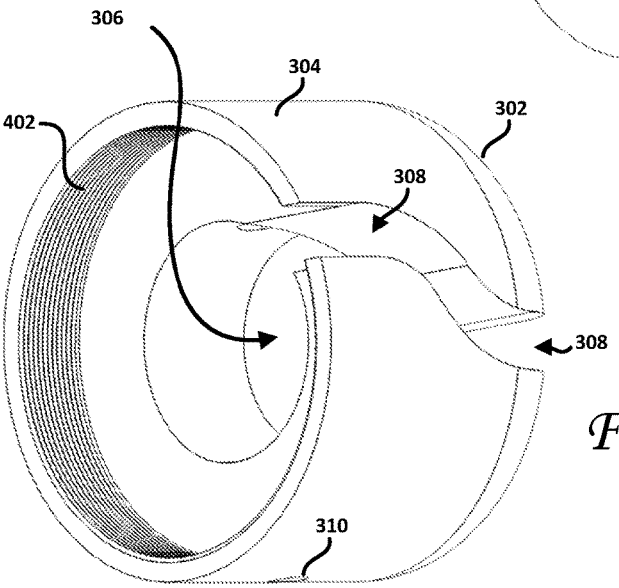
FIG. 4 is another perspective representation of a clamp cup, according to one embodiment.

FIG. 2 is a view of a connector support, according to one embodiment. FIG. 3 is a perspective representation of a clamp cup, according to one embodiment. FIG. 4 is another perspective representation of a clamp cup, according to one embodiment. One embodiment is a device comprising a clamp plug 302 (FIGS. 3 and 4) and a connector support 202 (FIG. 2). As shown, the connector support 202 may comprise, according to one embodiment, a generally cylindrical shape and may be configured to receive and support a first electrical connector. Such first electrical connector may be a data connector, a data and power connector or a power connector. The connector support 202 may be configured to support either a male or a female electrical connector. According to one embodiment, the connector support 202 may be configured to receive and support a male C14 power connector against a housing wall of a housing of an electrical device. As shown in FIG. 2, the connector support 202 may comprise a first surface 204 configured to face and attach to a housing wall and a second surface 206 that extends away from the housing wall. This second surface 206 may include a first mating structure. According to one embodiment, the first mating structure may comprise screw threads as shown in FIG. 2. Alternatively, the second surface 206 may include a first mating structure that includes structures other than screw threads. For example, the first mating structure may include bayonets or other interference-fit structures. As also shown in FIG. 2, the connector support 202 may define an opening 208 in the first surface 204, which opening 208 may be configured to enable an electrical connector to be inserted and received therein.

Figure 7:
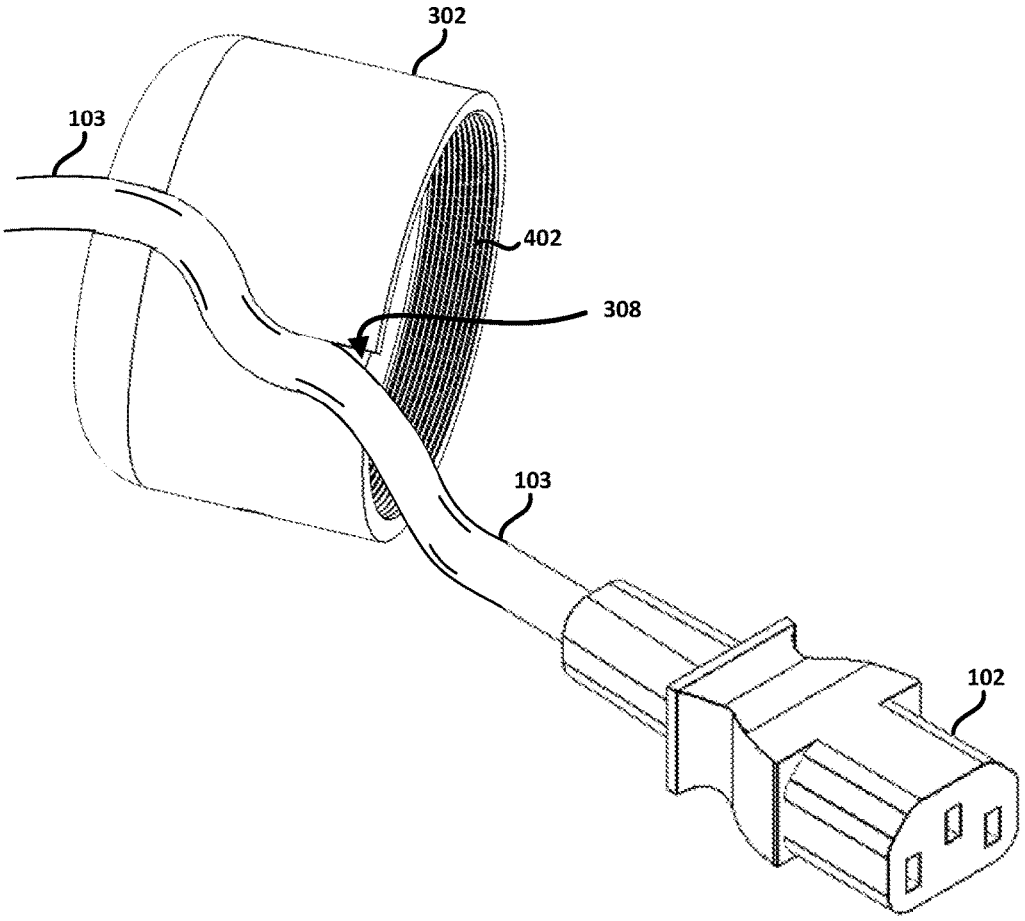
FIG. 7 is a view of a clamp cup according to one embodiment, illustrating the manner in which an electrical cord may be inserted into the channel defined therein, to receive the electrical connector therein, in preparation for mating to the electrical connector received within the connector support.

The clamp cup 302, one embodiment of which is shown in FIGS. 3 and 4, may be configured to receive and at least partially surround a cable and a second electrical connector attached to the cable, as best seen in FIG. 7, discussed further infra. The clamp cup 302 may comprise a centrally-disposed opening 306, to enable a cable to be received therein and protrude therefrom. This second electrical connector may be configured to mate with the first electrical connector received within the connector support 202. The clamp cup 302, according to one embodiment, may comprise an outer surface 304. The outer surface 304 may, as suggested in the figures, be substantially circular in cross-section. Alternatively, the cross-sectional shape of the outer surface 304 of the clamp cup 302 may be piece-wise linear, such as a high-order polygon, for example. The outer surface 304, according to one embodiment, may be shaped so as to allow hand-tightening of the clamp cup 302 against the connector support 202. Alternatively, the clamp cup 302 may be shaped so as to allow tightening via a manual or automated tool. According to one embodiment, an outer surface of the clamp cup 302 may comprise a first opening 310 and a second opening 310 that may be disposed substantially perpendicular to the longitudinal axis (see reference numeral 502 in FIG. 5C). The first and second openings 310 may be configured to enable a tool-assisted tightening of the clamp cup 302 against the connector support 202. Other structures may be provided in addition to or in place of the openings 310, to enable effective hand and/or tool-assisted tightening of the clamp cup 302 on the connector support 202. According to one embodiment, the openings 310 may be 5 mm in diameter.

As best seen in FIG. 4, the clamp tool 302 may comprise a second mating structure 402 disposed, in the embodiment illustrated in FIG. 4, within the interior surface of the clamp cup 302. According to one embodiment, the second mating structure of the clamp cup 302 may comprise screw threads that are configured to align and engage with the screw threads 206 of the connector support 202. Alternatively, the second mating structure of the clamp cup 302 may comprise any structure or structures that are configured to engage and mate with the first mating structure of the connector support 202.

Figure 5A:
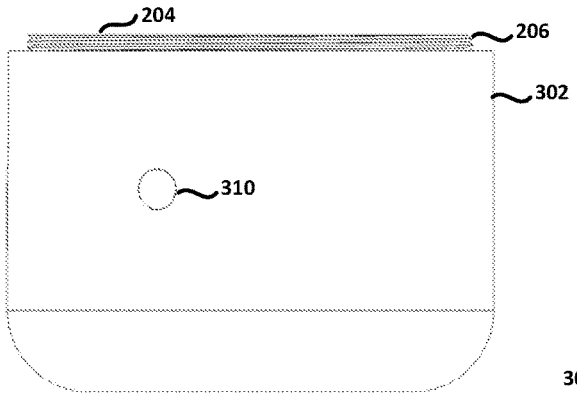
FIG. 5A shown a first view of a clamp cup and mated connector support, according to one embodiment.
Figure 5B:
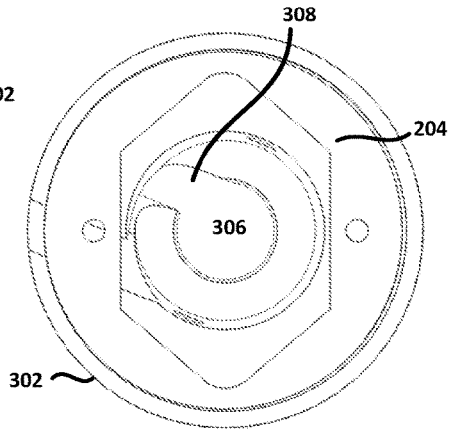
FIG. 5B shown a second view of a clamp cup and mated connector support, according to one embodiment.
Figure 5C:
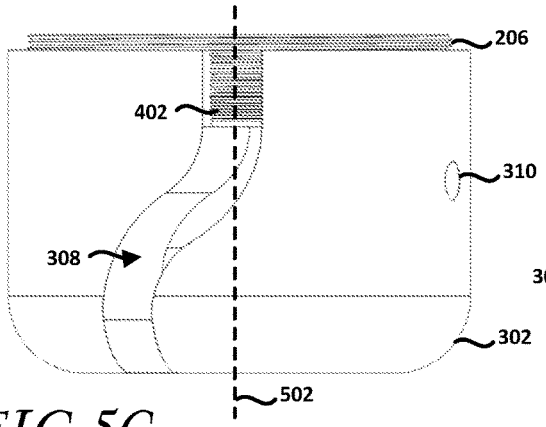
FIG. 5C shown a third view of a clamp cup and mated connector support, according to one embodiment.
Figure 5D:
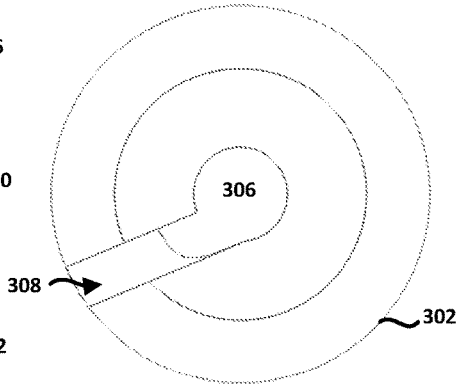
FIG. 5D shown a fourth view of a clamp cup and mated connector support, according to one embodiment.
Figure 5E:
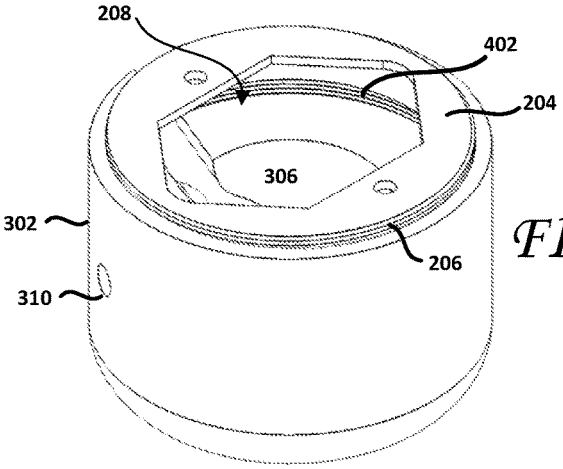
FIG. 5E shown a fifth view of a clamp cup and mated connector support, according to one embodiment.

According to one embodiment, the clamp cup 302 may be configured to removably fit over and attach to the connector support 202 by mutual engagement of the first mating structure with the second mating structure. The engagement can mate the second electrical connector to the first electrical connector received in the connector support 202 and hold the mated first and second electrical connectors against the housing wall. FIGS. 5A-5E show various views a clamp cup 302 and mated connector support 202, according to one embodiment. As best seen in FIGS. 5A, 5C and 5E, the first and second mating structures of the connector support 202 and the clamp cup 302, respectively, are configured for mutual engagement. For example, the threads (in one embodiment) of the first mating structure of the connector support 202 at least partially engage and thread within the threads (in one embodiment) of the second mating structure of the clamp cup 302. This mutual engagement causes the clamp cup 302 to fit over and attach to the connector support 202 and causes the opening 208 defined in the first surface 204 of the connector support 202 to at least partially align with the opening 306 defined in the clamp cup 302, as best seen in FIGS. 5B and 5D.

Figure 6:
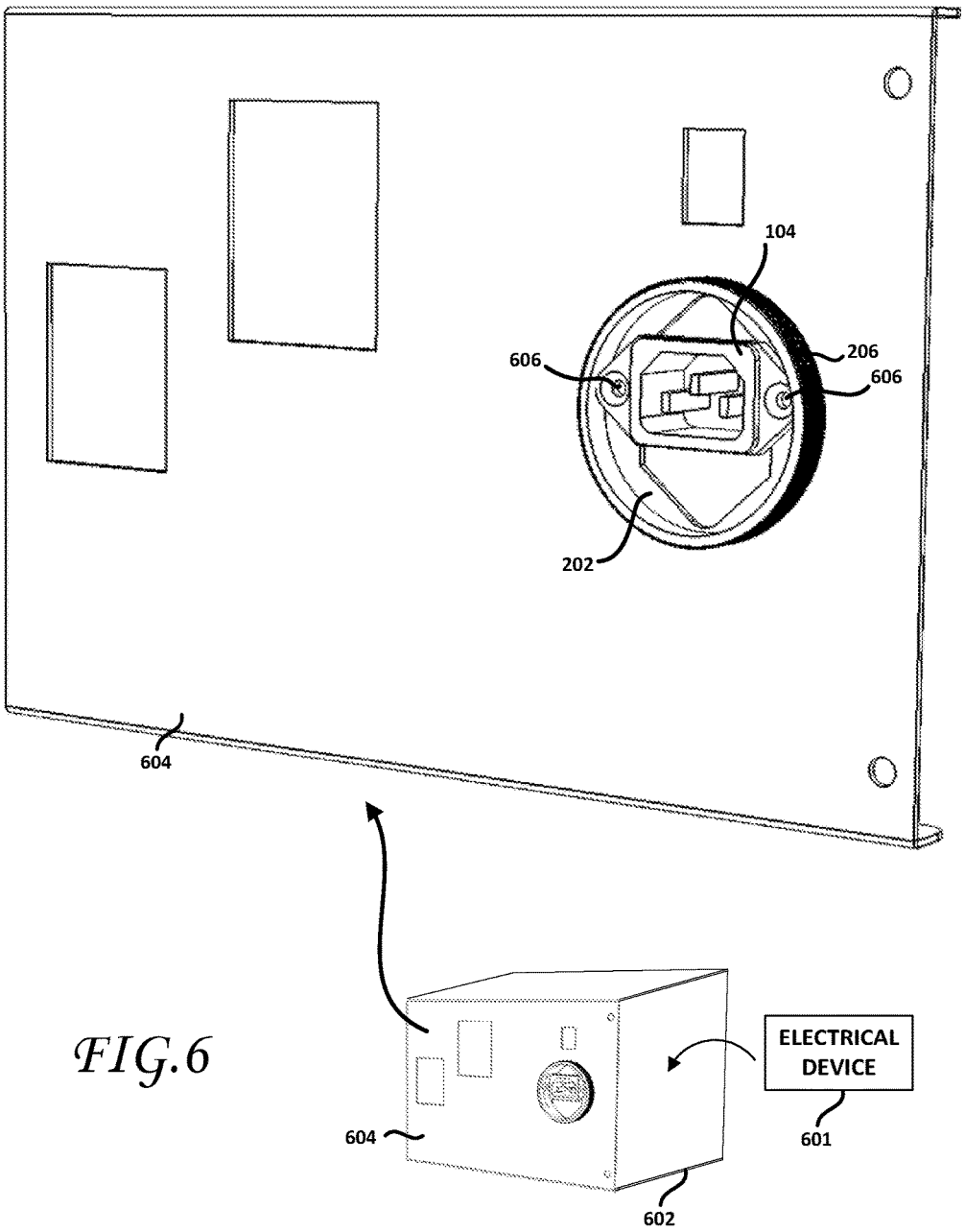
FIG. 6 is a view showing a housing wall of an electrical device, a connector support attached to the housing wall and an electrical connector received within the connector support, according to one embodiment.

In use, the connector support 202 may be configured to attach to a wall 604 of a housing 602 of an electrical device 601, as suggested at FIG. 6. The electrical device 601 may include a manufacturing machine, a consumer device, a data storage device or virtually any device that may benefit from a secure data and/or power connection. The wall 604 may comprise one or more cutouts according to the structure and functionality of the enclosed electrical device 601. One of these cutouts may be configured to accommodate the connector support 202, the first surface of which may be disposed externally to and against the wall 604. Fasteners 606 may be used to attach the connector support 202 against the housing wall 602. The connector 104 may be inserted within the opening of the connector support 202 in one orientation and thereafter rotated 90 degrees to assume the orientation shown in FIG. 6, to thereby align the fastener through bores on the connector 104 with the corresponding fastener through bores disposed within the connector support 202. Fasteners such as, for example, screws may then be inserted within the through bores and tightened, as shown at 606 in FIG. 6, thereby securing the connector support 202 and received connector 104 to the wall 604 of the housing of the electrical device 601. Electrical connections to the backside of the connector 104 may be made, to route power and/or data, as the case may be, from outside of the housing to the electrical and/or electronic circuits of the electrical device 601.

Referring back particularly to FIGS. 3, 4, 5B, 5C and 5D, the clamp cup 302 may comprise a surface that defines a channel 308 configured to enable the cable 103 to be inserted therein and removed therefrom. This is shown in FIG. 7, in which the cable 103 is being aligned with, and pushed through the channel 308. In one embodiment, the channel 308 defines a curved path. The curved path makes it harder for the cable 103 inserted within the channel 308 to accidentally pop back out. In one embodiment, the channel 308 defines a serpentine shape that is similar to the letter "S". Once the cable 103 is pushed through the channel 308 (using the operator's thumbs, for example, the connector 102 may be seated within the clamp cup 302, in a central position therein.

Figure 8A:
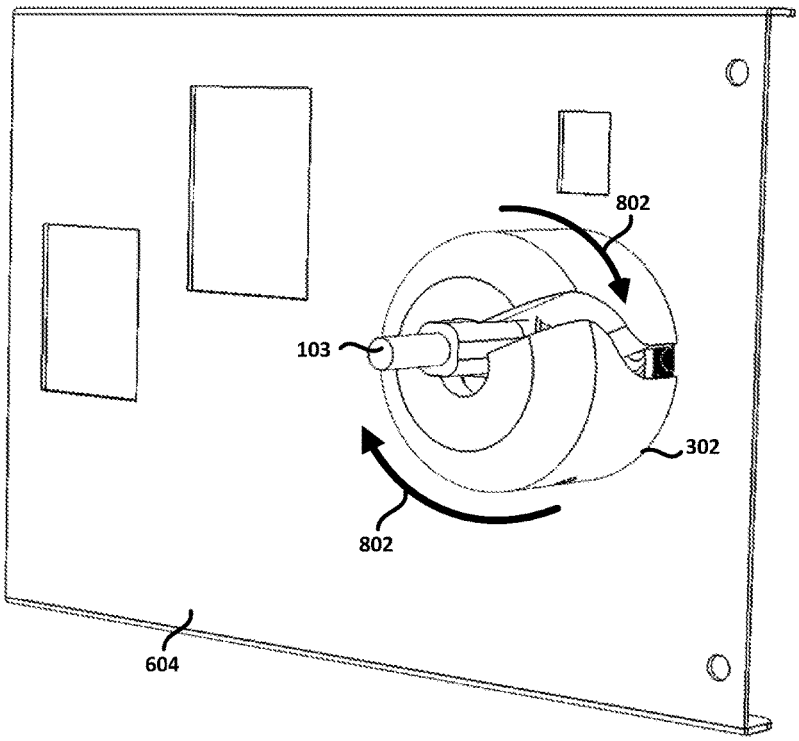
FIG. 8A shows a first view of an assembly according to one embodiment.
Figure 8B:
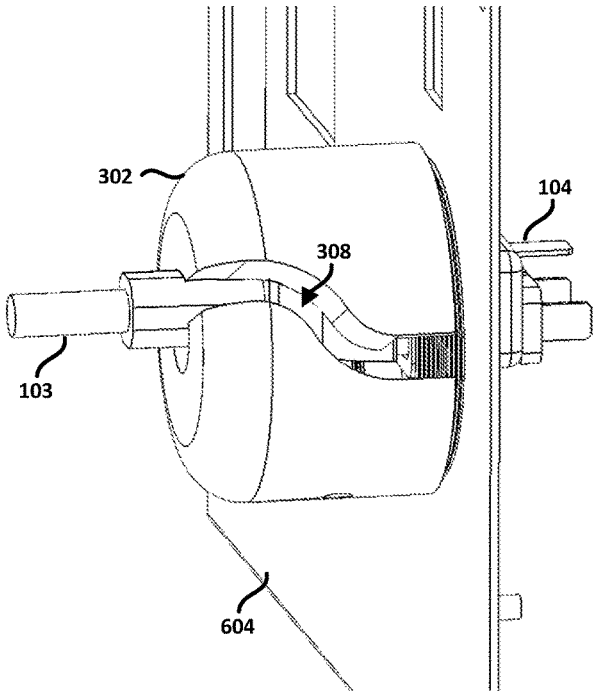
FIG. 8B shows a second view of an assembly according to one embodiment.

FIGS. 8A and 8B show a device according to one embodiment in use. As shown therein, after having inserted the cord 103 into the channel 308 of the clamp cup 302, the connector 102 may be plugged in to the mating connector 104. The clamp cup 302 may be advanced, over the cord 103, until the second mating structure of the clamp cup 302 is disposed against the first mating structure of the connector support 202. In the implementation in which the first and second mating structures comprise matching threads, the clamp cup 302 may be rotated against the stationary connector support 202 attached to the housing wall 604, as suggested at 802 in FIG. 8A, until the threads mutually engage one another. The engagement enables the clamp cup 302 to be threaded onto the connector support 202, all the while the connectors 102, 104 remain plugged into to one another. The clamp cup 302, in this manner, may be securely attached to and tightened against the connector support 202. Should the first and second mating structures incorporate mechanisms other than screw threads, the manner of securing the clamp cup 302 to the connector support 202 would correspondingly change, as appropriate for the attachment mechanism. In the implementation shown in FIGS. 8A and 8B, clockwise rotation of the clamp cup 302 tightens the clamp cup 302 against the connector support 202 (thereby exerting axial pressure on the connector 102 against the connector 104). Counterclockwise rotation of the clamp cup 302 against the connector support 202 allows the clamp cup 302 to be loosened from the connector support 202 and detached therefrom.

Once attached to one another, the clamp cup 302 and the connector support 202 at least partially surround the mated connectors 102, 104 and keep them captive. This can prevent their accidental disconnection from one another, as the size and shape of the opening in the clamp cup 302 furthest away from the housing wall 604 is purposefully too small and/or the wrong shape, in an embodiment, to allow the connector 102 to pass through. Once mated to one another, the clamp cup 302 and the connector support 202 are further configured to exert an axially-directed force (in this implementation, substantially perpendicular to the plane of the housing wall 604) on the second electrical connector against the first electrical connector, thereby ensuring a good electrical connection between the two mated connectors.

According to one embodiment, the connector support 202 and the clamp cup 302 may comprise or may be formed of plastic or a metal. In one implementation, the connector support may comprise stainless steel and the clamp cup may comprise a thermoplastic material such as, for example, an acetal homopolymer resin such as DuPont®Delrin®. Other materials may be used.

Advantageously, the present device reduces down time and loss of data caused by accidental disconnection of connectors. Although the drawings show and embodiment adapted for C13 and C14 power connectors, other connectors and form factors may be readily accommodated, as those of skill in this art may recognize.

The various features and processes described above may be used independently of one another, or may be combined in various ways. While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions and changes in the form of the methods and systems described herein may be made without departing from the spirit of the embodiments disclosed herein.

The invention claimed is:

1. A device, comprising:

a connector support configured to receive and support a first electrical connector and comprising:

a first surface configured to face and attach to a housing wall;

a second surface comprising a first mating structure comprising screw threads that extend away from the housing wall; and a third surface opposite the first surface, the third surface comprising an opening and a pair of through bores, the opening enabling the first electrical connector to be inserted through the opening in a first orientation, rotated and attached against the third surface in a second orientation with fasteners inserted through the pair of through bores; and a clamp cup configured to receive and at least partially surround a cable and a second electrical connector attached to the cable, the second electrical connector being configured to mate with the first electrical connector, wherein the clamp cup comprises:

an outer surface; and a second mating structure comprising screw threads configured to engage with the screw threads of the first mating structure, the clamp cup being configured to removably fit over and attach to the connector support by mutual engagement of the screw threads of the first mating structure with the screw threads of the second mating structure, which enables the second electrical connector to mate to the first electrical connector received in the connector support and enables the mated first and second electrical connectors to be held against the housing wall.

2. The device of claim 1, wherein:

the first electrical connector is a male electrical connector;

the connector support is configured to receive the male electrical connector;

the second electrical connector is a female electrical connector; and the clamp cup is configured to receive the female electrical connector.

3. The device of claim 1, wherein the outer surface of the clamp cup is configured to enable the clamp cup to be hand-tightened against the connector support.

4. The device of claim 1, wherein the clamp cup is configured to be removable from the connector support.

5. The device of claim 1, wherein at least one of the connector support and the clamp cup comprises at least one of a plastic and a metal.

6. The device of claim 1, wherein the clamp cup further comprises a surface that defines a channel configured to enable the cable to be inserted therein and removed therefrom.

7. The device of claim 6, wherein the channel defines a curved shape.

8. The device of claim 1, wherein the clamp cup defines a longitudinal axis that is substantially perpendicular to the housing wall when the clamp cup is attached to the connector support, wherein the attached clamp cup is configured to, when fitted to the connector support, exert an axially-directed force on the second electrical connector against the first electrical connector.

9. The device of claim 8, wherein the outer surface of the clamp cup comprises a first opening and a second opening that are disposed substantially perpendicular to the longitudinal axis, the first and second openings being configured to enable a tool-assisted tightening of the clamp cup against the connector support.

10. An assembly, comprising:

an electrical device;

a housing configured to house the electrical device and comprising a housing wall;

a connector support configured to receive and support a first electrical connector and comprising:

a first surface configured to face and attach to a housing wall;

a second surface comprising a first mating structure comprising screw threads that extend away from the housing wall, and a third surface opposite the first surface, the third surface comprising an opening and a pair of through bores, the opening enabling the first electrical connector to be inserted through the opening in a first orientation, rotated and attached against the third surface in a second orientation with fasteners inserted through the pair of through bores; and a clamp cup configured to receive and at least partially surround a cable and a second electrical connector attached to the cable, the second electrical connector being configured to mate with the first electrical connector, wherein the clamp cup comprises:

an outer surface; and a second mating structure comprising screw threads configured to engage with the screw threads of the first mating structure, the clamp cup being configured to removably fit over and attach to the connector support by mutual engagement of the screw threads of the first mating structure with the screw threads of the second mating structure, which enables the second electrical connector to mate to the first electrical connector received in the connector support and enables the mated first and second electrical connectors to be held against the housing wall.

11. The assembly of claim 10, wherein:

the first electrical connector is a male electrical connector;

the connector support is configured to receive the male electrical conductor;

the second electrical connector is a female electrical connector; and the clamp cup is configured to receive the female electrical connector.

12. The assembly of claim 10, wherein the outer surface of the clamp cup is configured to enable the clamp cup to be hand-tightened against the connector support.

13. The assembly of claim 10, wherein the clamp cup is configured to be removable from the connector support.

14. The assembly of claim 10, wherein at least one of the connector support and the clamp cup comprises at least one of a plastic and a metal.

15. The assembly of claim 10, wherein the clamp cup further comprises a surface that defines a channel configured to enable the cable to be inserted therein and removed therefrom.

16. The assembly of claim 15, wherein the channel defines a curved shape.

17. The assembly of claim 10, wherein the clamp cup defines a longitudinal axis that is substantially perpendicular to the housing wall when the clamp cup is attached to the connector support, wherein the attached clamp cup is configured to, when fitted to the connector support, exert an axially-directed force on the second electrical connector against the first electrical connector.

18. The assembly of claim 17, wherein the outer surface of the clamp cup comprises a first opening and a second opening that are disposed substantially perpendicular to the longitudinal axis, the first and second openings being configured to enable a tool-assisted tightening of the clamp cup against the connector support.

* * * * *